United States Patent [19]

Gottschling

[11] Patent Number: 4,901,495

[45] Date of Patent: Feb. 20, 1990

[54] EXPANSION JOINT FOR BRIDGING SPACED FLOOR STRUCTURES

[75] Inventor: Reinhard Gottschling, Essen, Fed. Rep. of Germany

[73] Assignee: MIGUA Hammerschmidt GmbH, Fed. Rep. of Germany

[21] Appl. No.: 377,330

[22] Filed: Jul. 10, 1989

[30] Foreign Application Priority Data

Aug. 26, 1988 [DE] Fed. Rep. of Germany ..... 3828980

[51] Int. Cl.[4] ..... E04B 1/62

[52] U.S. Cl. ..... 52/396; 52/573; 52/586; 404/64; 404/68

[58] Field of Search ..... 52/396, 573, 586; 404/64, 65, 66, 67, 68, 47

[56] References Cited

U.S. PATENT DOCUMENTS 4,823,531 4/1989 LaBelle ..... 52/586

FOREIGN PATENT DOCUMENTS 3518507 11/1986 Fed. Rep. of Germany ..... 52/396

*Primary Examiner*—David A. Scherbel
*Assistant Examiner*—Creighton Smith
*Attorney, Agent, or Firm*—Arthur B. Colvin

[57] ABSTRACT

A bridging apparatus for spanning the space defined between two relatively movable structural floor members includes anchor sections adapted to be mounted to the edges of the floors and a two part bridging unit having outer edges pivotally connected to the anchor members. One inner edge of a bridging member includes a spaced pair of legs defining a groove arrayed at an acute angle to the floor, the other bridging member including a tongue riding in the groove. The upper leg of the member defining the groove is wedge-shaped the upper surface of the leg being parallel to the floor structures when the same are aligned horizontally.

5 Claims, 4 Drawing Sheets

EXPANSION JOINT FOR BRIDGING SPACED FLOOR STRUCTURES

BACKGROUND AND FIELD OF THE INVENTION

This invention relates to a device for briding the span or space between two relatively movable sections of a structural floor and consists of two anchoring units and a bridging unit. The bridging unit is articulately connected at each of its outer longitudinal edges with an anchoring unit and is formed by two inter-engaging bridge members. One of the bridge members, which is of male die design, engages by a tongue in a groove of the other bridge member of corresponding female die design, more or less deeply depending on the width state of the joint.

THE PRIOR ART

Such a device is known from DE-PS 35 29 877, wherein the bridging unit consists of two bridging members extending perpendicular to the length of the joint and telescoping horizontally one in the other. One member is of a cross section in the form of a tuning fork and receives the other member of rectangular cross section between its legs. The outer edge strips of the bridge members facing away from each other are of cylindrical shape and are articulatedly supported in anchoring unit grooves of corresponding arcuate shell-like form.

With the known device, not only can the bridging of a joint of varying width between two structure parts be maintained, but also a relatively smooth transition can take place when the parts forming the structure floor shift relative to each other in a vertical direction. While the anchoring units are connected rigidly with the respective structure parts at the longitudinal edges of the joint, it is made possible for the bridging unit to pivot about the central axis of the bearing shells formed by the grooves in the anchoring units when the floor structure parts change their level relative to each other. Upon variation of the joint width, the bridging is maintained in that the two bridge members forming the bridging unit remain in engagement to a greater or lesser depth in telescope fashion.

Depending on the cross-sectional thickness of the bridge members, in the known device there necessarily results a more or less deep open channel between the end face of an upper leg of the tuning fork-shaped bridging member and the side opposite to that end face, of an upper edge strip of the anchoring unit. The width of the channel is dependent upon the spacing of the floor sections.

Not only is it expensive to keep the channels of the known device always clean in order not to impair the functionality of the device, but it is also disadvantageous in that the channels make it impossible to run smoothly over a floor equipped with such bridging devices. Rollers of vehicles can, depending on their outside diameter, sink into the channels and may considerably disturb the uniformity of the travel movement. The impact stresses then occurring may lead to damage both to the vehicles and to the devices covering the joints. Also there may be greater risk of accidents in walking over floors thus equipped, as shoe heels may catch in the channels. Generally speaking, the channels constitute hazards because there is no smooth transition.

SUMMARY OF THE INVENTION

It is an object of the invention to provide a sturdy device for bridging the joints between expansible floor structures made of two anchoring units and a bridging unit consisting of only two members, in which adequately strong members of the bridging unit make possible a transition from one structure part to the next which is smooth throughout over the joints.

To attain this object, a bridging apparatus is comprised of two anchor units pivotally connected to the outer marginal edges of a two part bridging unit. The bridging unit is in turn comprised of a first member having upper and lower legs defining a groove inclined at an acute angle or arc to the horizontal. The other unit has a tongue complemental to and slidably supported within the groove. The upper leg is wedge shaped, the upper surface of the leg being in coplanar alignment with the structural floors in the horizontally aligned condition thereof.

Due to the inclination - according to the invention- of the groove and tongue at an acute angle to the plane of the structure floor, not only the lower leg of the bridge member of the female bridge member, but also the leg that covers the groove can be made increasingly thicker at distances further from its free end, being thereby adapted to the bending moment curve. On the other hand, at the free end the leg thickness may be reduced so much that the top side of the leg covering the groove changes over into the top side of the tongue without a pronounced step formation. Within limitations of an acute angle, the greater the angle of inclination of the groove and tongue the more wedge-shaped can the legs of the female bridge member be made, thus ensuring an almost entirely level smooth transition from one structure part to the next.

According to an embodiment of the invention, the ends or edges of the bridge members facing away from the groove or tongue each have an arcuate form toward the structure floor and engage in a correspondingly curved groove provided in each anchoring unit.

Due to this design, the bridge members can be hooked up articulatedly with the anchoring units in such a way that in the assembled state the bridge members remain pivotable relative to the anchoring units but cannot be removed from the grooves of the anchoring units in an unauthorized manner.

To this end, the arcuate groove provided in each of the anchoring units is preferably limited toward the joint side by a cylinder piece and away from the joint side by a shell piece. The latter spans an arcuate edge strip of a bridge member and forms with it a smooth transition from the top side of the bridge member to an end face of the anchoring unit.

Preferably each anchoring unit is formed by an angle section having a leg, oriented perpendicular to the structure floor and pointing upward on which the cylinder piece and the shell piece are integrally formed.

If the device is to be used in structure floors which may be covered with covering of different thicknesses it may be advisable to form the anchor units of two pieces, namely a base unit attached to the floor comprising an angle section having a vertical leg, and a separate section attached thereto and carrying the cylinder and shell piece.

With such a design it suffices, for taking into consideration floor coverings of different thickness, to place upper sections of different height on uniform angle sections, to adapt the anchoring units to the thickness of the covering required in each instance.

Lastly a development of the invention provides that the cross-sectional central axis of the groove and tongue extends in a concave or convex arc whose radius corresponds to at least twice the maximum joint width.

By this design the smooth transition from one structure part to the next can be further improved in that the top side of the bridge members extend in a correspondingly concave or convex arc which, when there is a level change of one structure part relative to the other and also when the joint width between the structure parts changes, still ensures the smooth transition between them.

The advantages of the device according to the invention can be summaryized as follows:

The device constitutes a two-joint telescope system, with the bridging unit consisting of only two bridge members, and the two anchoring units being selectively formed as one-part of two-part units.

The device presents an essentially flat visible face, but even in case of three-dimensional relative movements of the structural parts provides a passage that can be traveled over without shocks.

The articulated hook type connection between the bridging unit and the anchoring units leads to a very favorable ration between the visible width and the maximum joint width.

The device can be executed in a low structural height, and moreover successive lengths of the device parts can be arranged offset to each other, so that a connection of equal side length and equal height of the device parts over the full joint length can be ensured.

Lastly, the device can be used to special advantage in hard floor finishes without recesses being necessary in the structure floor.

BRIEF DESCRIPTION OF DRAWINGS

The drawing shows four embodiments of the device according to the invention, each in transverse section.

DETAILED DESCRIPTION OF THE DRAWINGS

Figure 1:
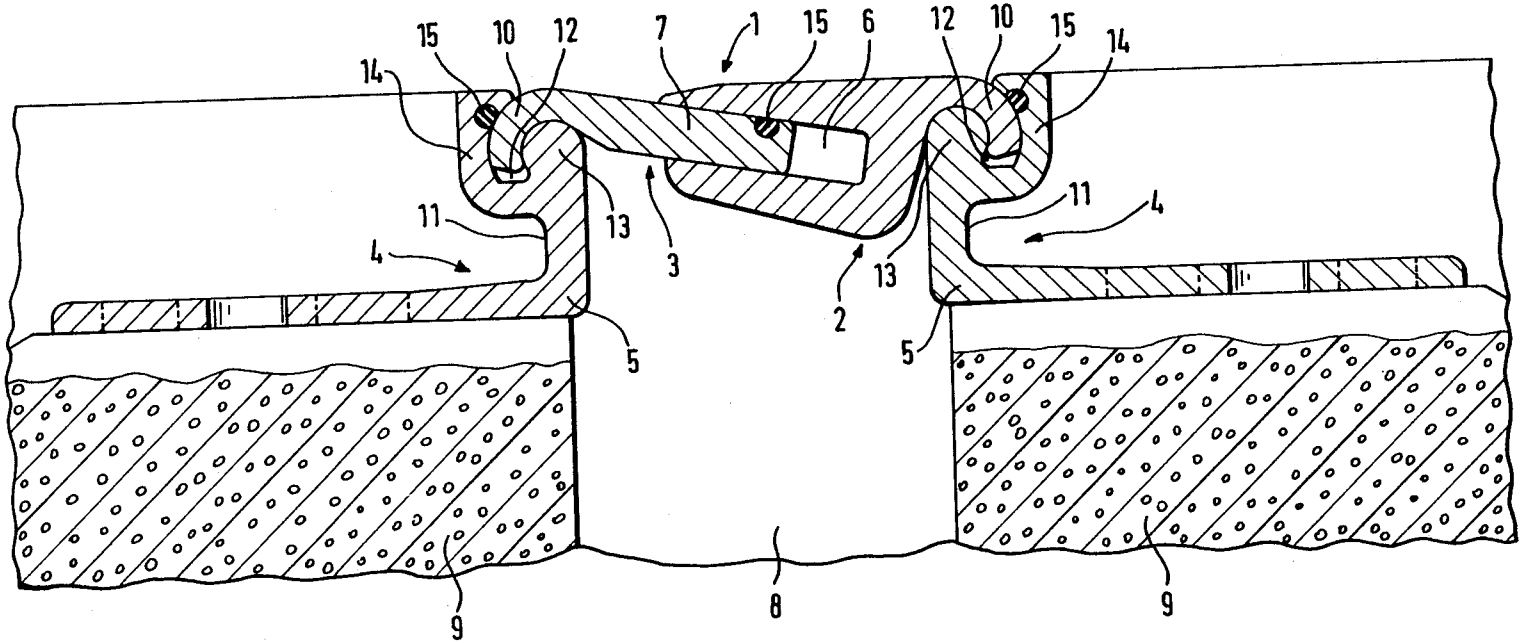
FIG. 1 is a device with a two-part bridging unit and two one-part anchoring units.

The device per FIG. 1 consists of a bridging unit 1 composed of two bridge member 2 and 3, and two anchoring units 4 which are each formed by an angle section 5.

The bridge member 2 has a groove 6, into which a tongue 7 of the bridge member 3 engages more or less deeply in telescope fashion depending on the width state of the span 8. By the span 8, two parts 9 of a structure floor shown in fragmentary view are separated from each other so that the parts can shift three-dimensionally independently of each other.

Through an edge strip or end 10 pointing downward in arcuate form, the bridge member 2 or 3 is articulatedly connected with one of the anchoring angle 5. To this end, in a vertical leg 12 of each anchoring angle 5 a groove 12 is provided, which is limited on the one hand by a cylinder piece 13 integrally formed on the leg 11 and on the other hand by a concentric arcuate shell piece 14 integrally formed on the leg 11.

Packing cords 15 extending over the length of the device are inserted in appropriately contoured grooves on the top side of tongue 7 and on the side of the shell pieces 14 facing the edge strip 10, in order thus to make the device water proof.

Figure 2:
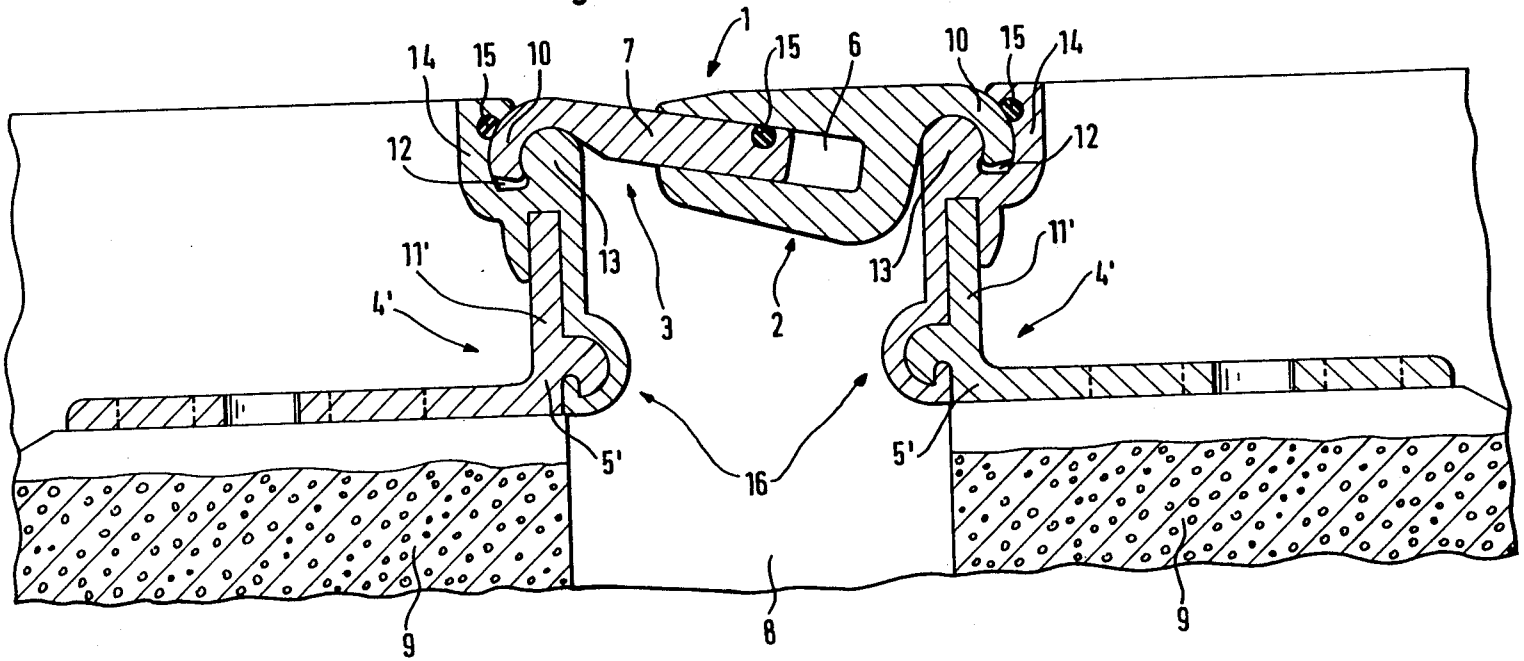
FIG. 2 a device similar to FIG. 1, but with two two-part anchoring units.

In the device according to FIG. 2, each anchoring angle 4' consists of an angle section 5', on whose vertically directed leg 11' an intermediate section 16 is tightly filled. As in the example per FIG. 1 the leg 11 of the intermediate section 16 is provided in the same manner with a groove 12 which is defined or limited laterally by a cylinder piece 13 and an arcuate shell piece 14.

Figure 3:
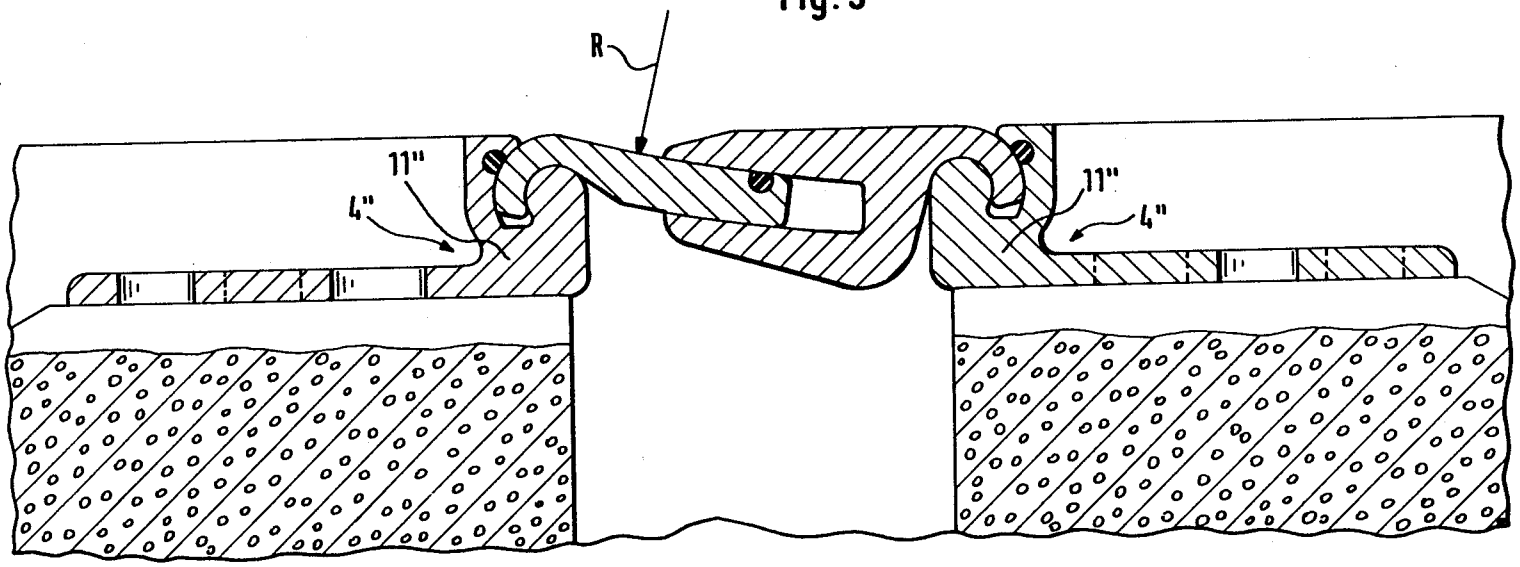
FIG. 3 a device with a concavely curved link between the bridging units.
Figure 4:
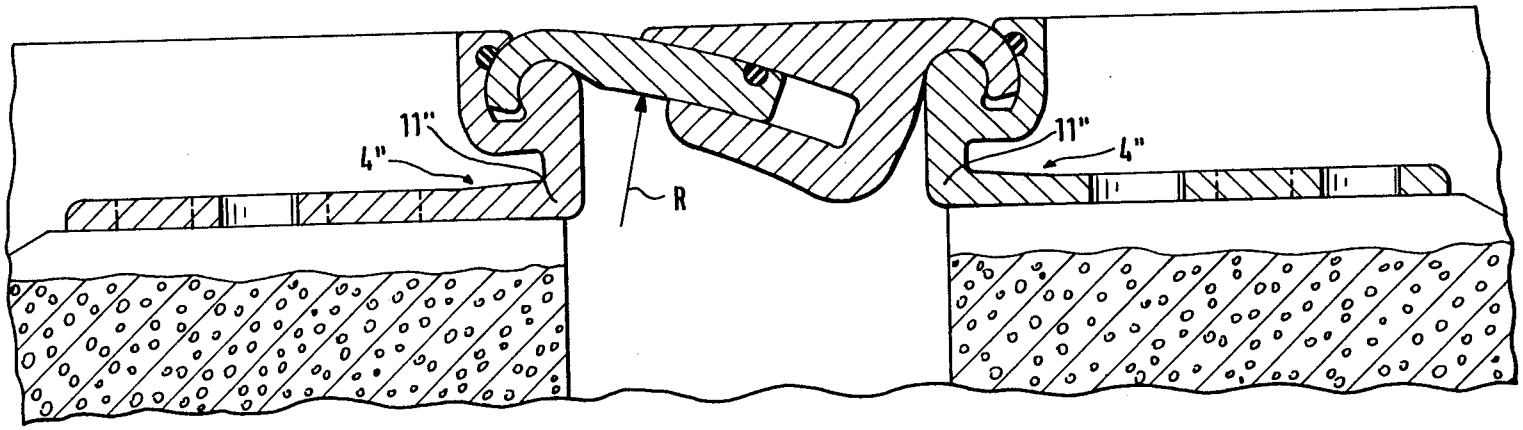
FIG. 4 A device with a convexly curved link between the bridging units.

In the device per FIG. 3 and 4, the anchoring units 4'' correspond, except for a squatter design of the legs 11'' of the angle sections 5'', to those in the example of FIG. 1. However, deviating from the examples illustrated in FIG. 1 and 2, the cross-sectional central axes of grooves 6 and of tongue 7 extend, not straight but, concavely and in FIG. 4 convexly according to a radius R. The radius R, as noted, is at least two times the maximum width to be spanned (joint width).

As will be appreciated from the preceding description there is provided, in accordance with the instant disclosure, a bridging apparatus adapted to span two relatively movable floor structures, which is capable of accommodating substantial relative movements of the floors in a variety of directions while still affording a smooth and easily cleaned transition. Numerous variations in details of construction may occur to the skilled worker familiarized with the instant disclosure which accordingly should be broadly construed within the scope of the appended claims.

I claim:

1. An apparatus for bridging a span defined between two relatively movable structural floor members comprising first and second elongate anchor units adapted to be mounted to the opposed edges of the respective said floor members and a bridging unit formed of first and second elongate bridge members, each said bridge member having a captive end pivotally connected to a respective said anchor unit for movement about a horizontal axis and a free end, the free end of said first bridge member including upper and lower spaced legs defining therebetween a groove upwardly inclined at an acute angle to the plane of said floor members, the free end of said second bridge member being downwardly inclined at said acute angle and slidably received within said groove, said upper leg being wedge-shaped in transverse section, becoming progressively thicker in the direction from said free end toward said captive end, the upper surface of said upper leg lying substantially in the plane of said floor members when said floor members are in coplanar alignment.

2. An apparatus in accordance with claim 1 wherein said anchor units include upwardly directed arcuate grooves, and said captive ends of said bridge members include complimentally curved arcuate tongues pivotably received in said arcuate grooves.

3. An apparatus in accordance with claim 2 wherein said grooves of said anchor units are defined by an inner cylindrical member and an outer concentric arcuate member.

4. An apparatus in accordance with claim 3 wherein said anchor units are comprised of an angle section adapted to be mounted to a structural floor member said angle section including an upwardly directed leg extending perpendicular to said floor member and a second section coupled to said leg of said angle section, said cylindrical member and arcuate member being formed on said second section.

5. An apparatus in accordance with claim 1 wherein said groove of said first bridge member and said free end of said second bridge member are of concentric arcuate configuration, the radius of said arcs being at least twice the maximum width of said span.

* * * * *